US006681831B1

(12) United States Patent
Cheng et al.

(10) Patent No.: US 6,681,831 B1
(45) Date of Patent: Jan. 27, 2004

(54) WINDOW COVERING HEIGHT ADJUSTMENT APPARATUS AND METHOD USING FIXED POSITION ROTOR

(75) Inventors: Li-Ming Cheng, Kaohsiung (TW); Lawrence S. Wu, Rowland Heights, CA (US)

(73) Assignee: Zipshade Industrial (B.V.I.) Corp., Diamond Bar, CA (US)

( * ) Notice: Subject to any disclaimer, the term of this patent is extended or adjusted under 35 U.S.C. 154(b) by 0 days.

(21) Appl. No.: 10/151,057

(22) Filed: May 17, 2002

(51) Int. Cl.[7] ..... E06B 3/48

(52) U.S. Cl. ..... 160/84.06; 160/172 R; 160/170

(58) Field of Search ..... 160/170 R, 172 R, 160/277, 84.06, 84.04, 178.1 R, 173 R, 168.1 R, 167 R

(56) References Cited

U.S. PATENT DOCUMENTS 2,486,492 A * 11/1949 Redman ..... 160/173 R
2,546,534 A * 3/1951 Znidarsic ..... 160/173 R
2,618,329 A * 11/1952 Nelson ..... 160/173 R
2,624,086 A * 1/1953 Schaefer ..... 403/202
2,697,487 A * 12/1954 Nelson ..... 160/173 R
2,874,612 A * 2/1959 Luboshez ..... 359/596
4,202,385 A * 5/1980 Voelz et al. ..... 141/59
4,673,018 A * 6/1987 Judkins ..... 160/84.06
5,158,127 A * 10/1992 Schumacher ..... 160/84.07
5,918,656 A * 7/1999 Daniels et al. ..... 160/168.1 R
5,918,658 A * 7/1999 Schartner ..... 160/178.1 R
5,947,176 A * 9/1999 Judkins ..... 160/168.1 R
6,059,004 A * 5/2000 Oskam ..... 160/84.04
6,131,640 A * 10/2000 Judkins ..... 160/168.1 R
6,443,207 B1 * 9/2002 Cheng et al. ..... 160/84.04
6,463,986 B1 * 10/2002 Gouda ..... 160/178.1 R

* cited by examiner

*Primary Examiner*—Blair M. Johnson
(74) *Attorney, Agent, or Firm*—William W. Haefliger

(57) ABSTRACT

A method of controlling the vertical height of a window shade having a top and bottom, which includes providing shade upper support structure at or proximate the shade top; providing at least one substantially vertically elongated shade support line extending downwardly from the upper support structure, and providing shade lower support structure at or proximate the shade bottom; elevating or lowering the shade lower support structure relative to one or more support lines; and securing the shade lower support structure to the line or lines at a selected height position relative to the line length above the lower support structure, whereby the height of the shade bottom can be quickly manually adjusted.

7 Claims, 7 Drawing Sheets

WINDOW COVERING HEIGHT ADJUSTMENT APPARATUS AND METHOD USING FIXED POSITION ROTOR

BACKGROUND OF THE INVENTION

This invention relates generally to control or adjustment of window coverings, and more particularly to ease and efficiency of window covering height adjustment. Such coverings are referred to as shades, and may be formed by pleats of a single piece of material, or by other configuration.

There is need for improvements in adjustability of such coverings or shades, as for example where the effective window covering height of the shade is to be adjusted. In the past, pleated shades were suspended by their own material, i.e. were allowed to hang, causing the weight of the shade to expand the pleats. It was then difficult to accurately adjust shade height, since over time the shade weight could expand the pleats, changing the overall height of the shade. Such pleated shades typically consisted of paper.

SUMMARY OF THE INVENTION

It is a major object of the invention to provide an easily adjustable means allowing shade height adjustment, and where only a minimum number of shade supporting lines are required.

Basically, the improvement comprises a) upper support structure at or proximate the shade top, b) at least one substantially vertically elongated shade support line extending downwardly from said upper support structure, c) shade lower support structure at or proximate the shade bottom, and shade adjustment includes:

d) elevating or lowering the shade lower support structure relative to the one or more support lines, e) and effectively securing the shade lower support structure at a selected height position relative to the line length, f) said securing including effecting attachment of the line to a fixed support relative to which the shade lower support structure is raised or lowered, g) whereby the height of the shade bottom can be quickly manually adjusted by adjustment of the height of the shade lower support structure.

In one example the attachment is effected by adjustable wrapping of the line about a rotary drum; and in another example, the line is attached or anchored to a part of the window frame. In that event, the invention contemplates providing a clip supporting the lower support structure, and adjusting the clip along the anchored line to clip to the line at a selected position at which the lower support structure is to be supported.

As will appear, the shade is typically provided in the form of a sequence of pleats, and the line or lines is or are located adjacent such pleats.

Another object includes provision for weight of the lowermost extent of the shade to be carried by the shade lower support structure as that lower support structure is elevated to shorten the height of the shade. As the shade lower support structure is adjusted upwardly, the line below that support structure is typically wound automatically by a fixed position drum or rotor relative to which the lowermost support structure travels up or down.

A further object is to provide for encasing the fixed position drum or rotor in a housing, and securing that housing on window frame structure.

Another object is to employ multiple lines to support the shade lowermost support structure, such lines transferring loading to the line wound on the drum.

A further object is to provide a spring associated with the drum, and acting to urge the drum in a rotary direction to wind the line.

Yet another object is to provide a housing upper opening to pass the line for winding on the drum.

An additional object is to provide a manipulable brake in association with the housing to brake rotation of the drum or travel of the line, in shade adjusted position, and alternatively to allow rotation of the drum or travel of the line for winding or unwinding as shade height is adjusted. Safety is enhanced.

These and other objects and advantages of the invention, as well as the details of an illustrative embodiment, will be more fully understood from the following specification and drawings, in which:

DRAWING DESCRIPTION

Figure 1:
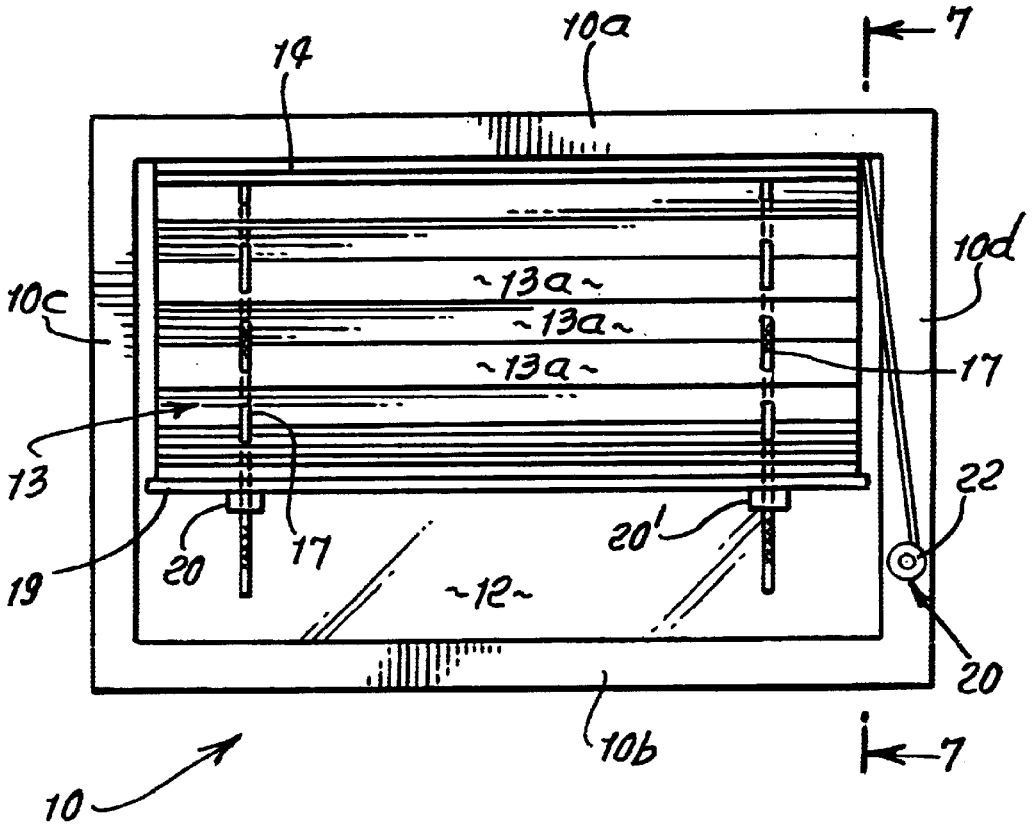
FIG. 1 is an elevation showing an adjustably supported window shade.
Figure 7:
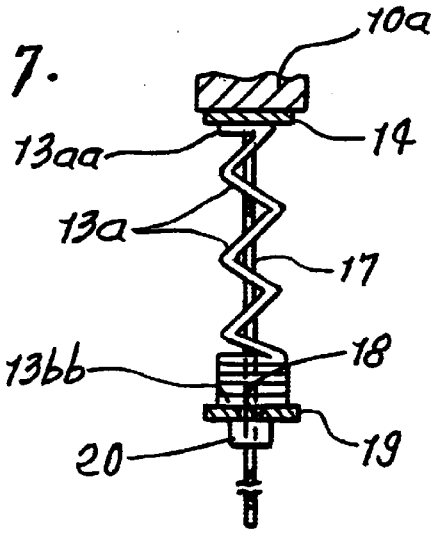
Figure 2:
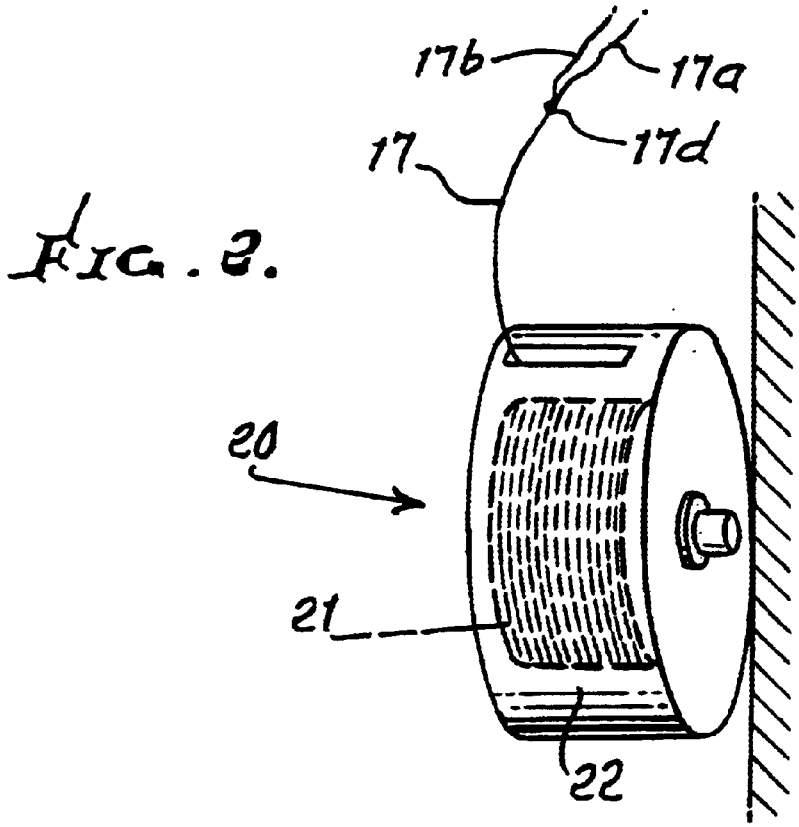
FIG. 2 is an enlarged perspective view showing use of a fixed position line wrapping device or cord adjuster.
Figure 2A:
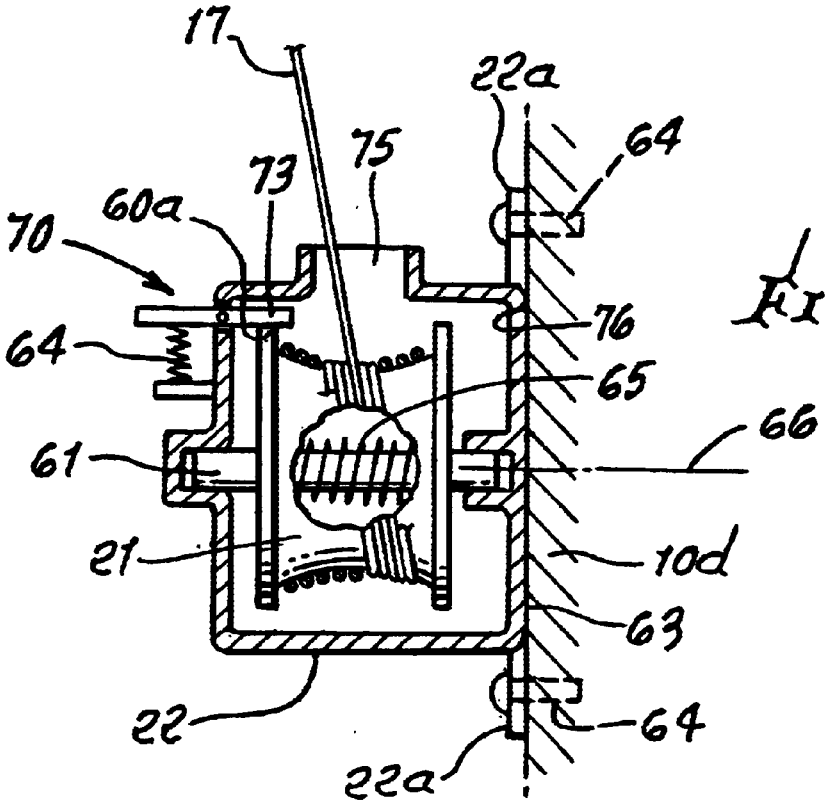
Figure 3:
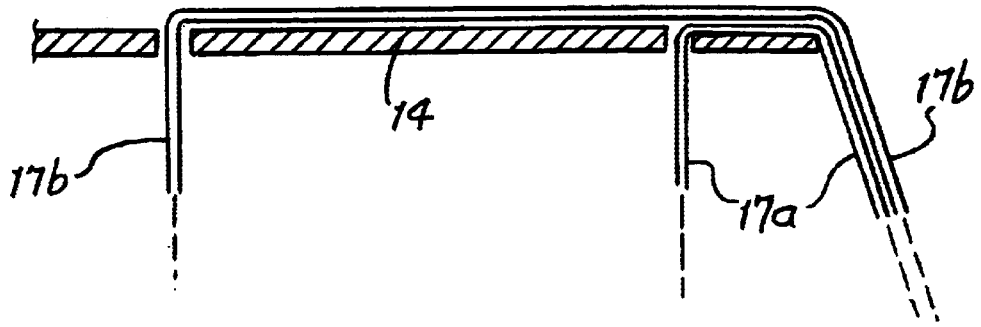
Figure 4:
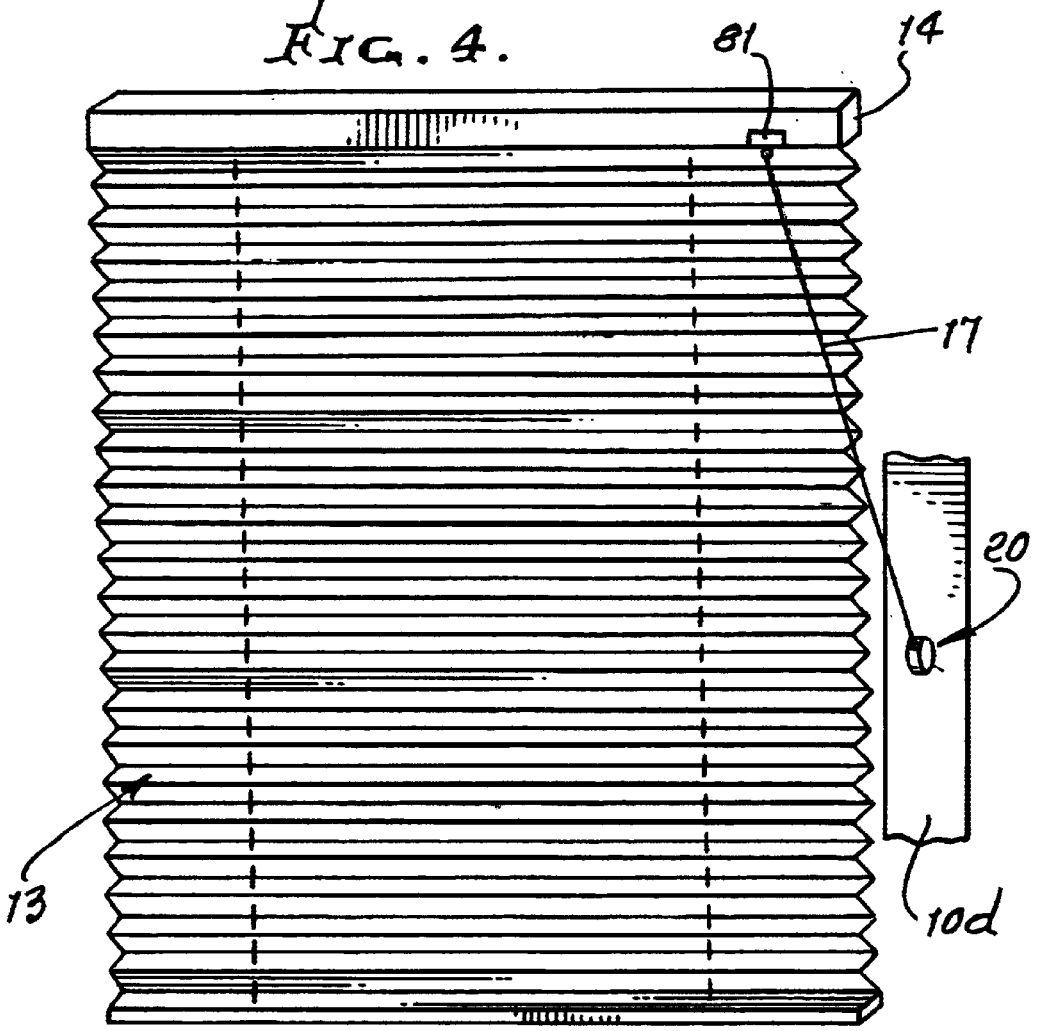
Figure 5:
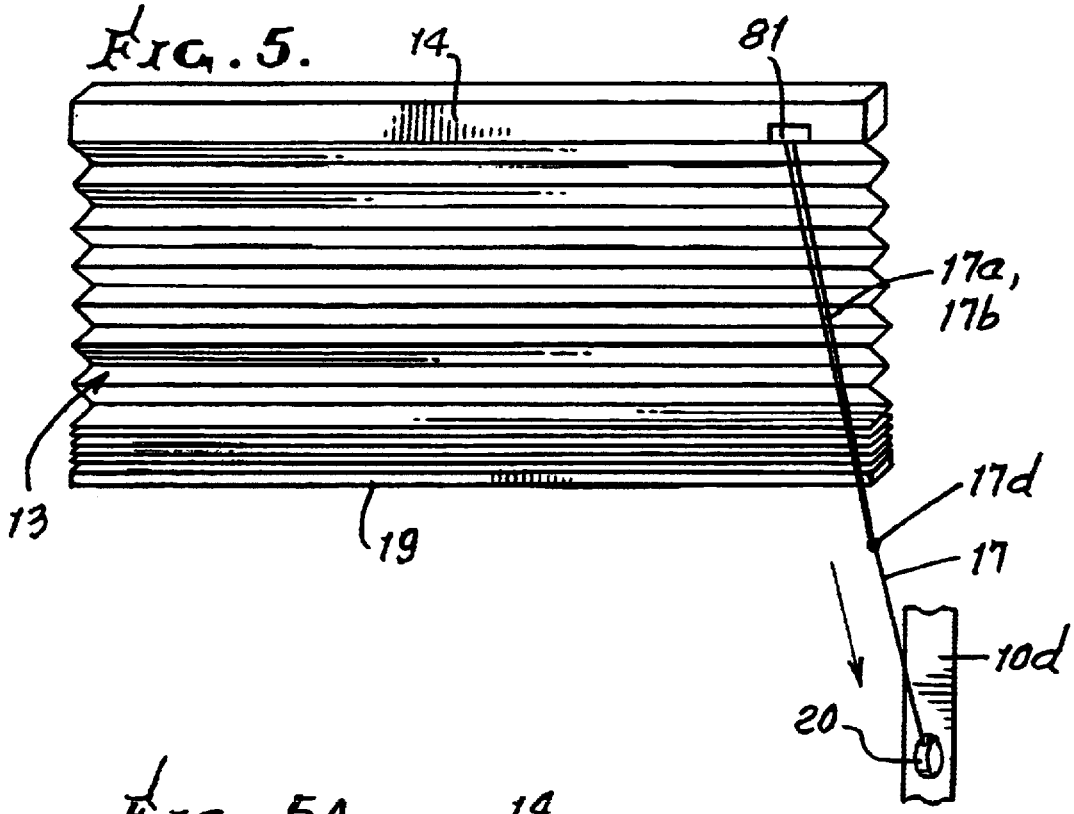
Figure 5A:
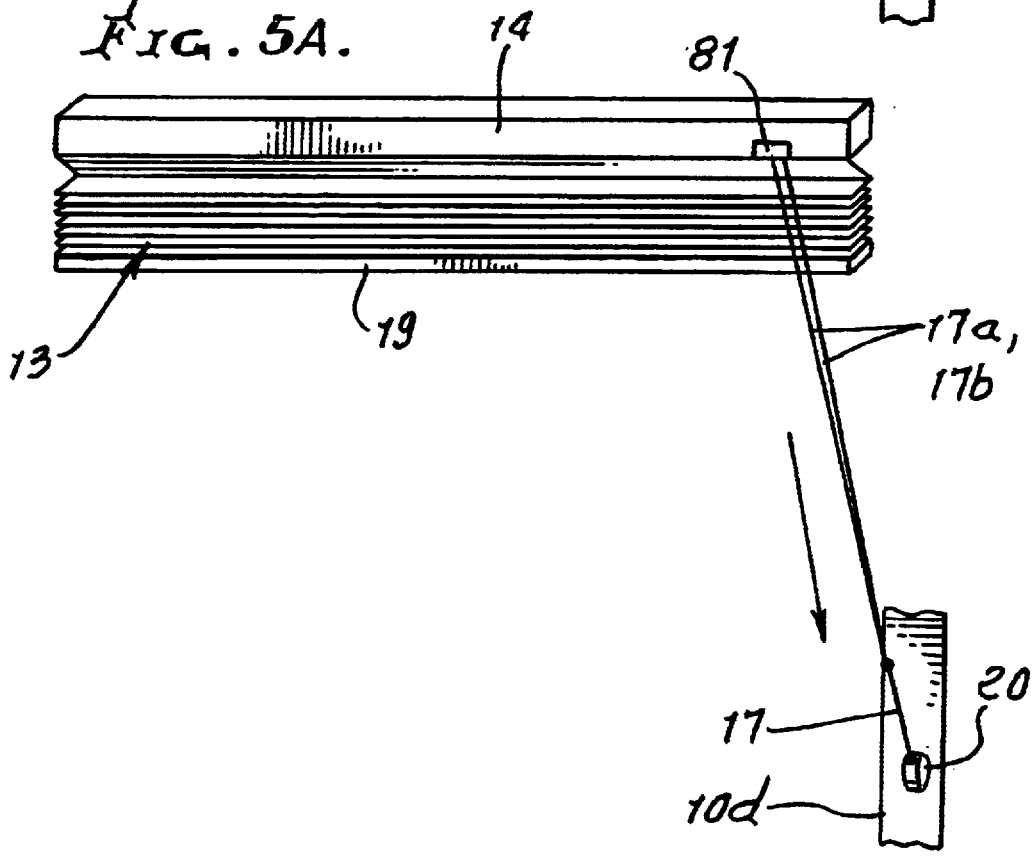
Figure 6:
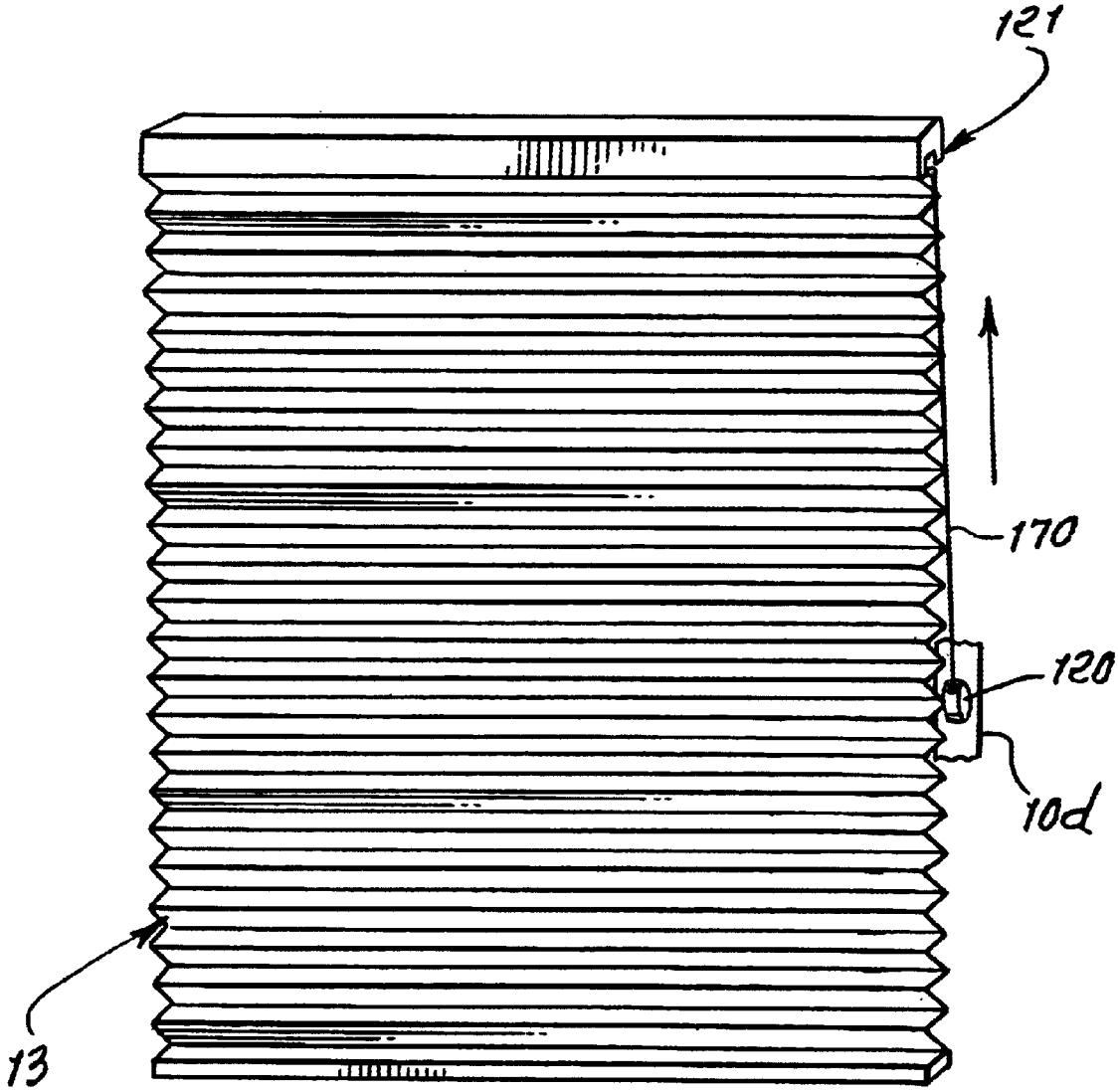
Figure 8:
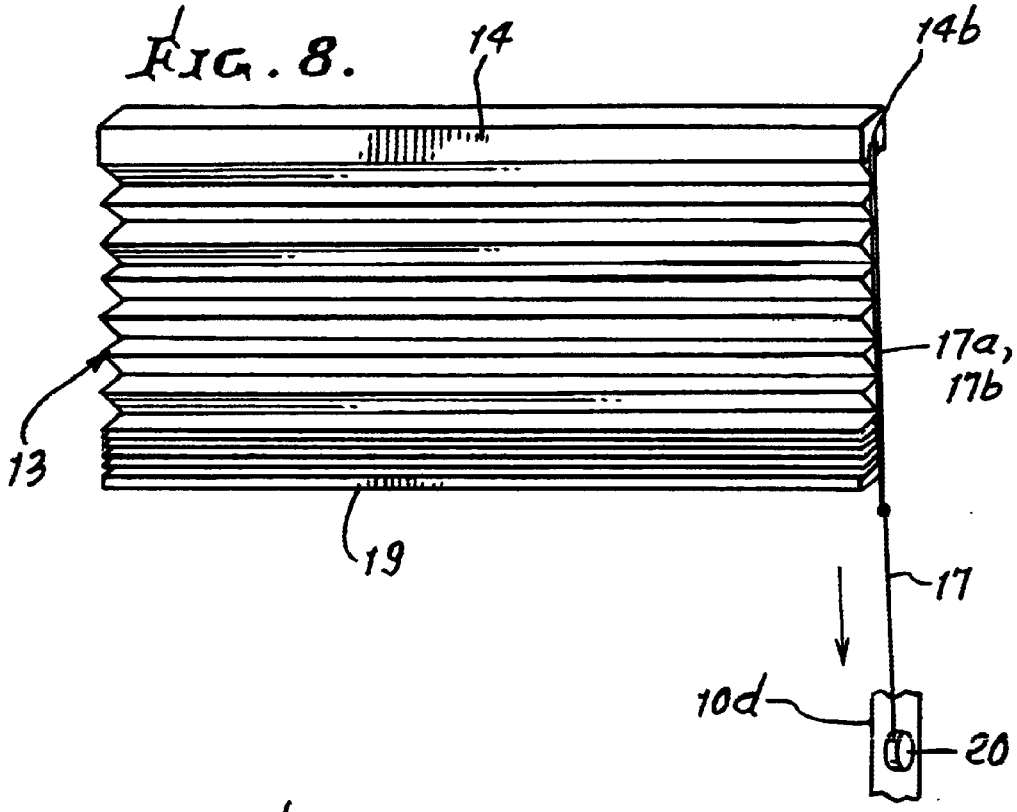
Figure 8A:
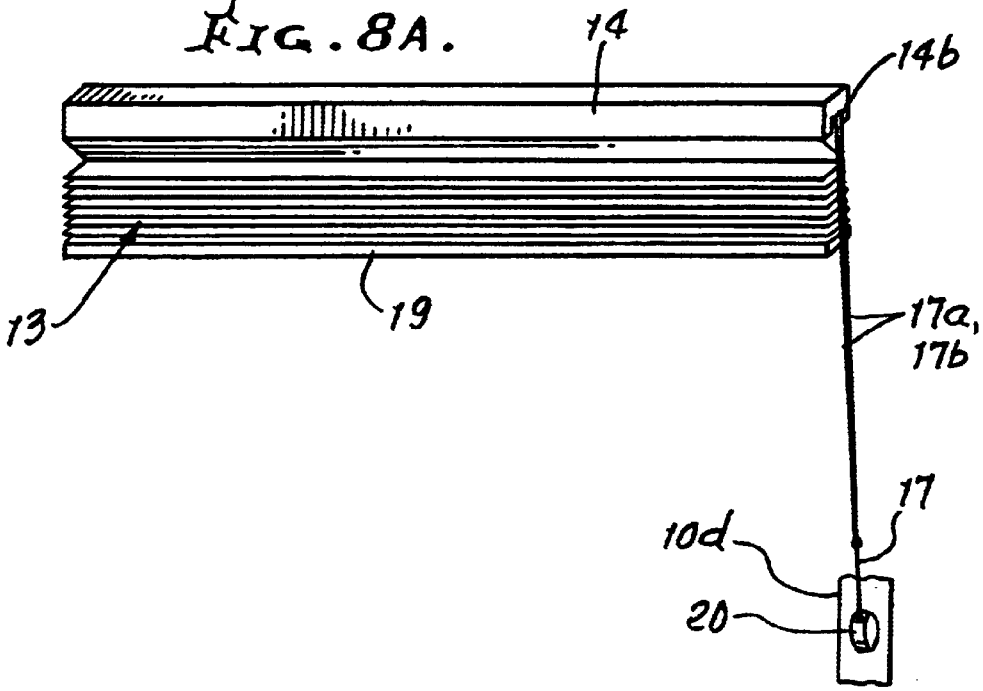

FIG. 2*a* is a section taken through the FIG. 2 device;

FIG. 3 is a section showing relationship of a single wrapping line to two lines at shade upper support structure;

FIG. 4 is an enlarged diagrammatic view showing shade lowering;

FIG. 5 is a view like FIG. 4 showing shade elevation; and FIG. 5*a* shows completion of shade elevation;

FIG. 6 is a frontal view of a completely lowered shade, with a fixed position control;

FIG. 7 is an end elevation taken on lines 7—7 of FIG. 1;

FIGS. 8 and 8*a* are views like FIGS. 5 and 5*a*, showing a modification.

Figure 9:
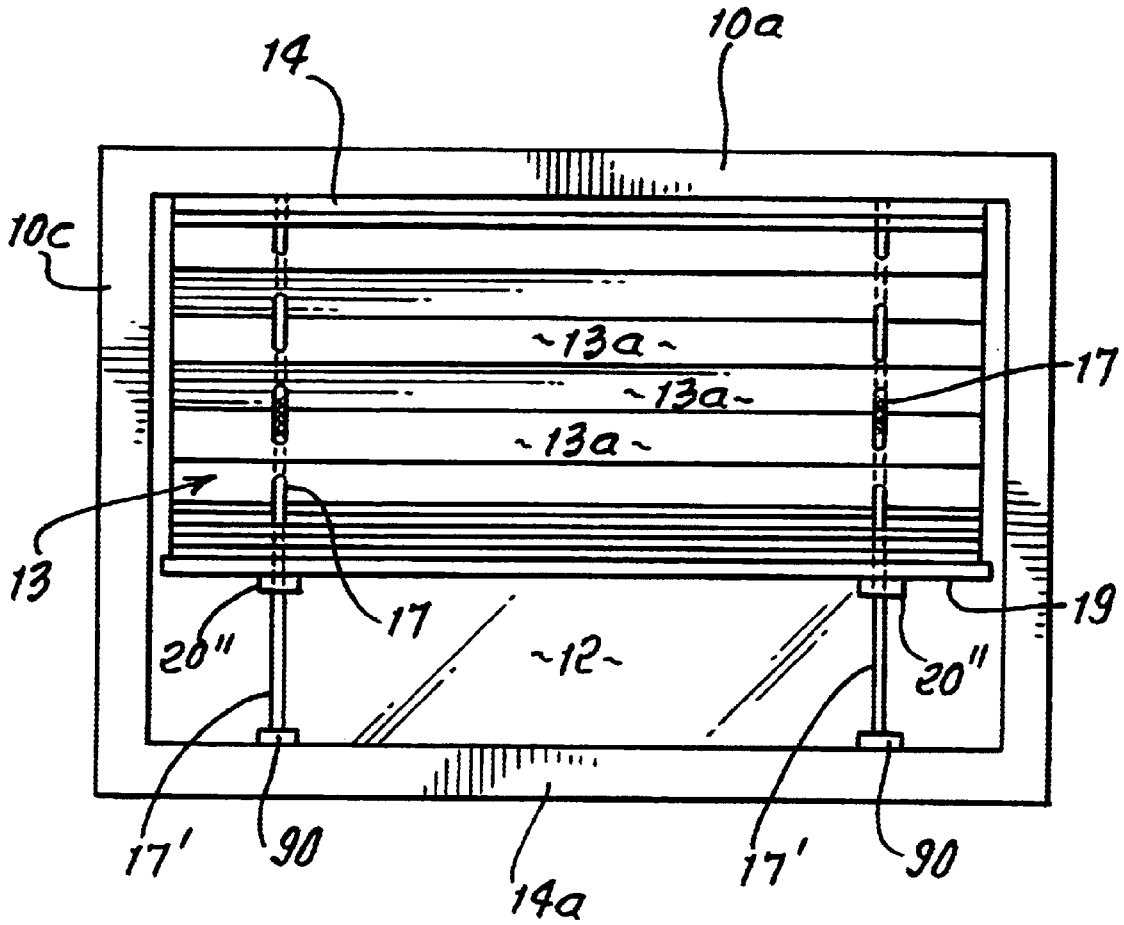

FIG. 9 is a view like FIG. 1 showing a further modification.

DETAILED DESCRIPTION

In FIG. 1, shade upper support structure is shown at 10, as in the form of a horizontal upper part 10*a* of a window frame. The frame also includes frame lower part 10*b*, and verticals at 10*c* and 10*d*. The window may for example include a glass pane 12.

A window shade or cover is shown at 13, and may include pleats 13*a*, which expand apart to extend diagonally back and forth, when the shade is hung. An upper shade support structure is located at or proximate the shade top. See for example horizontal slat 14 the upper side of which may be attached to the frame part 10*a*, as for example by tape having adhesive at its opposite sides.

At least one, and preferably two support lines or cords 17 are suspended from slat 14, the two illustrated lines 17 being spaced apart horizontally. Those lines pass downwardly through holes in the pleats, as seen in FIG. 7, and they also pass downwardly loosely through holes or openings 18 in a shade lower support structure located at or proximate the shade bottom. As shown, the lower support structure comprises a horizontally elongated lower slat 19. The uppermost pleat 13*aa* may be attached to the underside of the upper slat 14; and the lowermost pleat 13*bb* may be attached to the upper side of the lower slat 19. The attachments may be made by use of dual adhesive sided tape.

The shade height may therefore be adjusted by manually elevating or lowering the lower slat 19, relative to the line or lines 17, and securing it in adjusted position.

Such securing is preferably made by a fixed position line wrapping adjusting device 20, whereby the lower slat 19 is held in selected elevated position by device 20. As shown in FIG. 1, the device 20 is fixed to the window frame member 10*d*, and controls wrapping of a line section 17*a* on a drum 21 in a case 22. The opposite end of line is attached to a holder 20' supporting slat 14. The method of use includes:

d) elevating or lowering the shade lower support structure relative to one or more support lines, e) and effectively securing the shade lower support structure to the line or lines at a selected height position relative to the line length above the lower support structure, f) such securing including effecting adjustable wrapping of a line about a rotary drum provided at a fixed support position relative to which the shade lower support structure is raised or lowered, g) whereby the height of the shade bottom can be quickly manually adjusted by adjustment of the height of the shade lower support structure having securement to said line or lines.

FIGS. 2 and 2*a* show a rotary drum 21 on a shaft 61 carried inside a case or housing 22. The case is affixed to window frame part 10*d* but can be affixed to another frame part, or part associated with the frame. A flange or abutment or abutments 22*a* on the case has a flat side 63 engaging to the frame part, and fasteners 64 may be employed to firmly attach the case to the frame.

A spring 65 in the case urges the drum 21 in a rotary direction about axis 66, tending to wind-up the line 17 on the drum. One end of the spring can be connected to the case, and the other end to the drum. The upper end of line 17 is attached to line extensions 17*a* and 17*b* that extend to the slat 19, or to connections 20' at the bottom of the shade, to raise and lower slat 19, (and the shade from its lower end) as the line 17 spools onto and off the drum. See also FIG. 3. Accordingly, as the slat 19 is raised (by hand or by pulling down on line 17) the drum automatically winds up the line 17 that would otherwise hang slack. Likewise, as the slat 19 is pulled down, or lowered, the drum automatically rotates to spool off the amount of wound line 17 that accommodates such movement.

A brake 70 is typically provided in association with the housing or case 22 to brake rotation of the drum, or travel of the line, in shade adjusted position, and to allow rotation of the drum or travel of the line for winding or unwinding as shade height is adjusted. Merely as illustrative, FIG. 2*a* shows brake part 73 engaging the drum hub or flange 60*a* to brake its rotation. When part 73 is pressed down, externally of the case, the part 73 pivots to disengage the flange 60*a*, to allow its rotation. An auxiliary spring 64 presses against the part 73 to urge it against the flange. Other types of brakes for drum 21 are usable, and are contemplated by the invention. Line 17 passes through an upper opening 75 in the case 22.

The case can be located on the front side 76 of the frame part 10*d*, or on or at the inner side of the frame part 10*d*.

FIGS. 3–5 show line extensions 17*a* and 17*b* extending upwardly from a connection 17*d* to line 17, then through front opening 81 in 14, laterally within or on the shade part 14, and then downwardly within the shade, at laterally spaced locations, as shown in FIGS. 1 and 3.

FIGS. 5 and 6 schematically show operation of shade lowering; and FIG. 5*a* shows shade raising.

FIG. 8 also schematically shows operation of shade lowering in a modified form of the invention; and FIG. 8*a* shows shade raising. In these views, the lines 17*a* and 17*b* exit from an opening 14*b* in the end of the shade upper support 14, whereas in FIGS. 4, 5 and 5*a*, the lines 17*a* and 17*b* exit from an opening 81 in the front side of the support part 14.

In FIG. 9, elements comprising of those in FIG. 1 bear the same identifying numerals. The elements 20", corresponding to 20' are clips or holders that releasably clip to the lines 17. Upper ends of the lines attach to the upper frame 14, and no structure 20 and 22 is used. The lower extents 17' of lines 17 are attached or anchored to a fixed support, such as lower window frame member 14*a*, as at hold-down locations 90. Lines 17 pass through the clips or holders 20", but the latter may be squeezed to release from the lines, and vertically adjusted along the lines, as by two-handed manipulation of the two holders 20" thereby raising or lowering the pleat lower support structure or slat 19. The clips may have jaws which normally clip to the lines 17 to hold the clips in adjusted vertical positions, the jaws being releasable from the lines by squeezing, to allow vertical adjustment. The FIG. 9 form of the invention is preferred.

FIG. 6 also shows a single line 170 extending upwardly from drum 120, to mechanism 121 that raises and lowers the two lines 17 as in FIG. 1. Mechanism 121 may advantageously comprise drums or rotors not shown on which lines 17 are spooled or wound, and a drum or rotor not shown on which line 170 is wound, the latter drum or rotor having gearing to drive gearing not shown on at least one of said drums or rotors for lines 17. A single line 170 is used for safety (a child's head cannot be trapped between two parallel lines).

We claim:

1. The method of controlling the vertical height of a window shade having a top and bottom, and left and right ends, which includes the steps a) providing shade upper support structure at or proximate the shade top, b) providing at least one elongated shade support line extending downwardly from said upper support structure, c) and providing shade lowermost support structure at or proximate the shade bottom, said support line extending downwardly through the shade and to and through said lowermost support structure at a location between said left and right ends of the shade, and being anchored below said lowermost support structure, d) elevating or lowering said shade lower support structure relative to at least a portion of said one or more support line or lines, e) and effectively securing said shade lower support structure to the line or lines at a selected height position relative to the line length above said lower support structure, f) said securing including effecting attachment of the line or lines to a fixed support relative to which the shade lower support structure is raised or lowered, g) whereby the height of the shade bottom can be quickly manually adjusted by adjustment of the height of the shade lower support structure.

2. The method of claim 1 wherein said shade is provided in the form of a sequence of pleats, and said line or lines is or are located adjacent said pleats.

3. The method of claim 1 wherein the weight of the lowermost extent of the shade is carried by said shade lower support structure as said lower support structure is elevated to shorten the height of the shade.

4. The method of claim 1 including extending the line downwardly from said lowermost support structure and anchoring the line to a fixed frame member below the level of said lower support structure.

5. The method of claim 4 including providing a clip supporting said lowermost support structure, and adjusting the clip along the anchored line to clip to the line at a selected position at which said lowermost support structure is to be supported.

6. Apparatus for controlling the vertical height of a window shade having a top and bottom, and left and right ends, which includes a) shade upper support structure at or proximate the shade top, b) at least one substantially vertically elongated shade support line extending downwardly from said upper support structure, c) and shade lower support structure at or proximate the shade bottom, said support line extending downwardly through the shade and to and through said support structure at a location between said left and right ends of the shade, d) said apparatus adapted for elevating or lowering said shade lower support structure relative to said one or more support lines, e) a securing device for effectively securing said shade lower support structure to the line or lines at a selected height position relative to the line length above said lower support structure, said securing device effecting anchoring of the line below said shade lower support structure at a fixed support relative to which the shade lower support structure is raised or lowered, f) whereby the height of the shade bottom can be quickly manually adjusted by adjustment of the height of the shade lower support structure effective securement to said line or lines.

7. The apparatus of claim 6 in which said securing device includes:

i) a hold-down to anchor a lower extent of the line to said fixed support, and ii) a holder having releasable clipping attachment to the line, directly below said lower support structure, whereby the holder supports the lower support structure when clip-attached to the line and at selected vertical positions, and the holder is normally releasable to allow its vertical adjustment to vertically adjust the position of said lower support structure.

* * * * *